United States Patent [19]

McCown, Jr. et al.

[11] Patent Number: 4,925,345

[45] Date of Patent: May 15, 1990

[54] BUILDING FOUNDATION STABILIZING AND ELEVATING APPARATUS

[75] Inventors: William B. McCown, Jr., Allen, Tex.; William B. Bolin, Ada, Okla.

[73] Assignee: Powerlift Foundation Repair, Ada, Okla.

[21] Appl. No.: 309,779

[22] Filed: Feb. 10, 1989

[51] Int. Cl.[5] ..... E02D 7/20

[52] U.S. Cl. ..... 405/232; 405/230

[58] Field of Search ..... 405/228, 229, 230, 232, 405/244, 249; 175/19, 122, 162, 203; 173/19; 52/125.1, 126.1, 126.5, 170, 745, 749; 254/29-31, 89 H

[56] References Cited

U.S. PATENT DOCUMENTS

| | | | |
|---|---|---|---|
| 3,763,654 | 10/1973 | Matsushita | 405/232 |
| 3,796,055 | 3/1974 | Mahony | 405/230 |
| 3,992,890 | 11/1976 | Pryke | 405/232 |
| 4,405,115 | 9/1983 | Boyadjieff | 405/228 X |
| 4,673,315 | 6/1987 | Shaw et al. | 405/230 |
| 4,678,373 | 7/1987 | Langenbach | 405/230 |
| 4,695,203 | 9/1987 | Gregory | 405/230 |
| 4,765,777 | 8/1988 | Gregory | 405/230 |

FOREIGN PATENT DOCUMENTS

| | | | |
|---|---|---|---|
| 2522398 | 12/1975 | Fed. Rep. of Germany | 405/232 |

*Primary Examiner*—Randolph A. Reese

*Assistant Examiner*—John Ricci

*Attorney, Agent, or Firm*—Moore & Hansen

[57] ABSTRACT

Apparatus for stabilizing and elevating the foundations of buildings of the type utilizing a foundation bracket which is positioned in supporting engagement with the building foundation. The apparatus includes a tubular guide sleeve and an upper head assembly from which one or more power cylinders are supported with their piston rods extending downwardly along side piling pipe sections which are driven into the ground through the guide sleeve adjacent to the foundation to form a support column. The piston rods are connected to a slip clamp which is constructed and arranged to grip a piling section and push it downwardly upon the downward, maximum power extension stroke of the piston rods, and to release the piling upon the upward, retraction stroke of the piston rods. Vertically extending connecting rods which support the upper head assembly are detachably connected at their lower ends to a lower cross arm unit attached to the foundation bracket. A second clamp device connected to the foundation bracket assembly may be used to engage a piling section upon the return stroke of the power cylinder piston rods, when the aforesaid slip clamp is released, so as to prevent the downward movement of the foundation bracket, and thus of the building foundation, on each piston return or nondriving stroke.

13 Claims, 3 Drawing Sheets

BUILDING FOUNDATION STABILIZING AND ELEVATING APPARATUS

BACKGROUND OF THE INVENTION

This invention relates to apparatus for stabilizing, shoring, and raising foundations for buildings.

In certain soil conditions, a common problem encountered is the settling of the foundations of buildings, with resultant damage to building structures, including cracks and fissures. This problem has been addressed rather extensively in the prior art through the development and use of various types of foundation shoring and lifting devices incorporating a bracket which engages the footing or vertical wall of a building foundation in such a way that the upward, reaction force of a hydraulic cylinder utilized in combination with the foundation bracket to drive pilings or pier-pipe into the ground under the foundation is transmitted to and resisted by the weight of the building. U.S. Pat. No's. 4,678,373 and 3,902,326 to Langenbach, U.S. Pat. No. 2,982,103 to Revesz et al, U.S. Pat. No. 3,852,970 to Cassidy, and U.S. Pat. No. 4,708,528 to Rippe all disclose such types of apparatus incorporating a hydraulic cylinder supported above and directly in line with piling sections to be successively driven into the ground and coupled together so as to form a continuous, vertically extending pipe-pier or piling for supporting a foundation by connection to the aforesaid foundation bracket. Langenbach and Rippe, as well as Shaw et al in U.S. Pat. No. 4,673,315, disclose that the pilings should be driven downwardly until bedrock or load-bearing strata is reached, after which continued driving force applied downwardly to the piling by the hydraulic drive cylinder causes an upward reaction force which may be utilized to lift a foundation back upwardly to the desired elevation.

With the exception of Shaw et al, all of the aforesaid prior art devices mount the hydraulic drive cylinder at a particularly high location along the side wall of a building by means of a vertically extending support structure that is secured to the foundation bracket, with the downwardly extending piston of the hydraulic cylinder impacting on the top end of the pilings or pier-pipes which are successively driven into the ground. Such arrangements present a problem as to being able to drive the full length of each piling section into the ground, because the stroke of the piston is not long enough to drive a piling of the desired length completely from an above-ground location down into the ground. Revesz addresses this problem by the use of a cross-brace from which his hydraulic drive cylinder is suspended downwardly, with the brace being adjustable vertically along a pair of upwardly extending support posts which are secured at their lower ends to the foundation bracket. Rippe utilizes a separate spacer bar mounted between the bottom of the downwardly extending cylinder piston and the top of a pier section in order to permit his cylinder to fully drive a pier section into the ground over its entire length.

As disclosed in U.S. Pat. No. 4,673,315, Shaw et al overcomes the aforesaid problem to some extent by mounting a pair of hydraulic drive cylinders to one side of the drive path of shoring pipes and connecting the hydraulic cylinders between a foundation bracket and a slip coupling. The slip coupling functions in such a way that it grips each pipe section upon the downward, retraction stroke of the cylinder pistons, and slides freely up along the pipe section on the extension stroke of the pistons in order to grip or bite each pipe section successively so as to pull it downwardly into the ground. In the Shaw system, the maximum available driving force of the hydraulic cylinders is not utilized, because the shoring pipes are pulled down into the ground on the retraction stroke of the cylinder pistons, rather than on the extension stroke. Because of the larger piston area on the end thereof opposite its connecting rod, the hydraulic fluid pressure applied to that end of the piston will develop a greater driving force.

In U.S. Pat. No. 3,796,055, Mahony discloses apparatus for supporting and raising a building foundation wherein the hydraulic drive cylinder for the pilings is mounted to one side of the piling drive path with the cylinder mounted so that its piston does extend downwardly and is connected by a clamp to successive lengths of pilings so as to drive the piling sections into the ground upon the extension stroke of the cylinder piston and connecting rod. However, Mahony connects his drive piston to the piling sections below a foundation bracket, at a level below the footing of a building foundation, thus requiring a particularly deep and large excavation below the building foundation to accommodate his drive apparatus.

It is also noted that the patents to Shaw et al, Langenbach and Rippe all disclose the use of a tubular guide sleeve affixed or connected to a foundation-engaging bracket in such a way as to serve as a tubular guide member for the piling sections as they are driven into the ground. In the patent to Shaw et al, as well as in Langenbach U.S. Pat. No. 4,678,373, the foundation bracket assembly has a right angle shape comprising a tubular guide segment projecting vertically along the vertical face of the foundation wall, and with a generally horizontally extending member extending under the foundation footing for engagement therewith. Similar apparatus is disclosed in Gregory U.S. Pat. No. 4,695,203 as well as in May U.S. Pat. No. 4,634,319. With the systems disclosed in both of those patents, the pier-pipe or piling sections are first driven into the ground to the point of contacting bedrock or a firm resistance by a first hydraulic drive cylinder or power-driving means. Thereafter, a lifting unit or device is mounted on the top piling section above the ground and a separate hydraulic cylinder jack is then utilized between the lifting member and the building foundation structure to elevate the foundation to the desired level. Such apparatus and methods are costly and cumbersome and unduly add to the expense of foundation-shoring operations.

British Pat. Specification No. 1,418,164 is of interest for the disclosure of a foundation-supporting apparatus utilizing a pair of hydraulic cylinders to drive pilings into the ground adjacent to a building foundation. The hydraulic cylinder pistons extend upwardly and are connected to a crosshead from which connecting arms project downwardly for connection to a one-way chuck or clamp. The slip clamp slides upwardly along the piling pipes when the rams are extended, and upon the downward, retraction stroke of the rams, the chuck or clamp grips the piling and pulls it downwardly. A special frame is utilized to mount the hydraulic cylinders for proper driving operation.

A further problem encountered in utilizing foundation shoring and lifting apparatus as described above is that in apparatus such as that disclosed in Shaw et al U.S. Pat. No. 4,673,315, the foundation tends to settle downwards slightly or flex in a downward direction on each return or nondriving stroke of the hydraulic cylinder piston. Thus, as disclosed in U.S. Pat. No. 4,673,315, when the piston rods extend upwardly to take a further grip on a piling or pier-pipe section, the foundation under which the cylinder-mounting bracket is engaged tends to settle back downwardly. Such constant upward and downward movement of a foundation, even over a distance of a fraction of an inch, during pile-driving operations can be damaging to the foundation and building structure. In U.S. Pat. No. 4,012,917 to Gendron, there is disclosed a jacking apparatus for raising an offshore platform wherein a pair of hydraulic cylinders are utilized to engage and lift platform-lifting legs. Two sets of leg or pipe-engaging clamps are incorporated on the jacking apparatus in such a way that one set of clamps engages the lifting leg on the upward, extension stroke of the cylinder pistons, with the other set of clamps releasing at that time. Just the opposite occurs on the return stroke of the pistons, with the other or second set of clamps gripping the legs and preventing relative movement in the opposite direction. The Gendron double-clamp arrangement would not lend itself to utilization with building foundation supporting and lifting apparatus as described with respect to the prior art discussed above.

BRIEF SUMMARY OF THE INVENTION

This invention has as its objective the provision of apparatus for stabilizing and elevating building foundations through the use of a foundation-engaging bracket and power cylinder assembly which is relatively compact, power efficient, requires a minimal excavation for set up and use, and can be quickly and easily positioned and operated to drive support pilings into the ground as well as to lift a foundation which has settled.

These basic objectives are realized by such apparatus which is particularly characterized by a multiple power cylinder drive assembly removably mounted on a generally L-shaped foundation bracket in such a way that the power cylinders are positioned above the foundation bracket with their drive piston rods extensible downwardly for driving connection with a piling section on the maximum power, extension stroke of the reciprocating pistons in the power cylinders. The same power cylinders are used to drive piling sections adjacent a building foundation as well as to elevate the foundation after the pilings have been driven down to bedrock or a load-bearing strata, without having to move, relocate, or adjust the power cylinders or their mounting assembly in any way.

This advantageous arrangement is achieved in the preferred embodiment by mounting a pair of hydraulic cylinders from an upper head assembly from which the cylinders depend downwardly at laterally offset locations with respect to the vertical path of support pilings to be driven into the ground through a vertically extending tubular guide sleeve on the foundation bracket. The foundation bracket further includes an elongated support segment which is adapted to be positioned horizontally under a building foundation. The upper head assembly is supported at an elevated location by a pair of vertically extending connecting rods which are detachably secured at their lower ends to a lower cross arm attached to the foundation bracket at the location of the tubular guide sleeve.

As a further beneficial feature, the driving connection of the cylinder pistons to a piling section or pier-pipe is achieved by a slip clamp vertically positioned between the foundation bracket and the aforesaid upper head assembly. The slip clamp embraces lengths of pilings inserted therethrough and includes slip members so constructed and arranged as to grip a piling section upon the downward, driving stroke of said cylinder pistons and to release the piling section upon the upward, retraction stroke of the pistons.

In order to overcome the problem of the "flexing" or slight downward movement of a building foundation when the piling sections are released during the return stroke of the piling drive pistons, a second slip clamp is preferably utilized. The second slip clamp is positioned along the vertical drive path of the support pilings, and is constructed and arranged so as to permit the piling sections to slip therethrough as they are driven downwardly, but to grip the piling section being driven during the return or retraction stroke of the drive pistons. The second slip clamp may be positioned at any desired vertical location with respect to the foundation bracket, and is connected thereto either directly or indirectly. The slight lowering of the foundation bracket, and thus of the building foundation, on the return stroke of the piling drive pistons is resisted by the clamping action of the second slip clamp on the piling sections.

These and other objects and advantages of the invention will be readily understood as the following description is read in conjunction with the accompanying drawings wherein like reference numerals have been used to designate like elements throughout the several views.

DESCRIPTION OF THE PREFERRED EMBODIMENT

Figure 2:
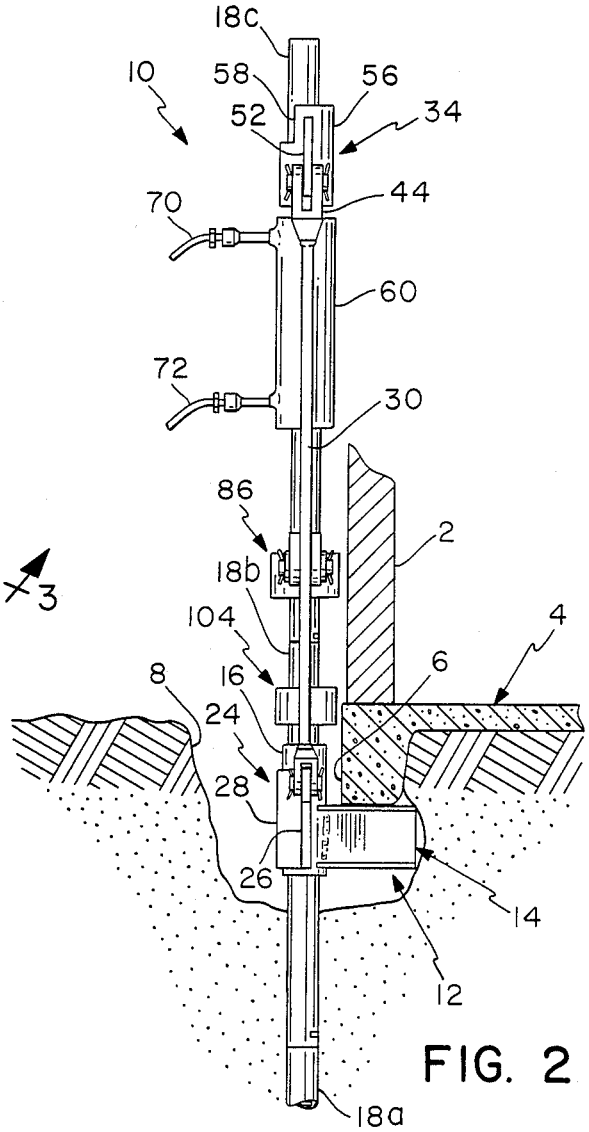
FIG. 2 is a side elevation view showing the apparatus of FIG. 1 in its position of use adjacent to a building foundation.

Referring now to the drawings, there is shown in FIG. 2 portions of a building structure with the improved foundation stabilizing and lifting apparatus of this invention assembled in operating position with respect to the building side wall 2 and foundation footing 4. The footing includes a vertically extending portion 6. An excavation indicated by reference numeral 8 is first dug adjacent to the foundation in order to provide a working space for the lift apparatus 10.

The lift apparatus includes a foundation bracket generally indicated by reference numeral 12, and having an elongated, foundation-engaging support segment or arm 14 and a vertically oriented, tubular guide sleeve 16 extending generally at a right angle thereto. Guide sleeve 16 is utilized for guiding piling sections **18*a*, 18*b*, and 18*c*** as they are driven into the ground in a manner hereinafter set forth. The pilings preferably comprise tubular pipe sections or piers cut from steel tubing to the desired length. Because of the advantageous mounting arrangement of the hydraulic drive cylinders for the piling sections, as hereinafter set forth, the piling sections may each be from 4 to 6 feet in length.

Figure 1:
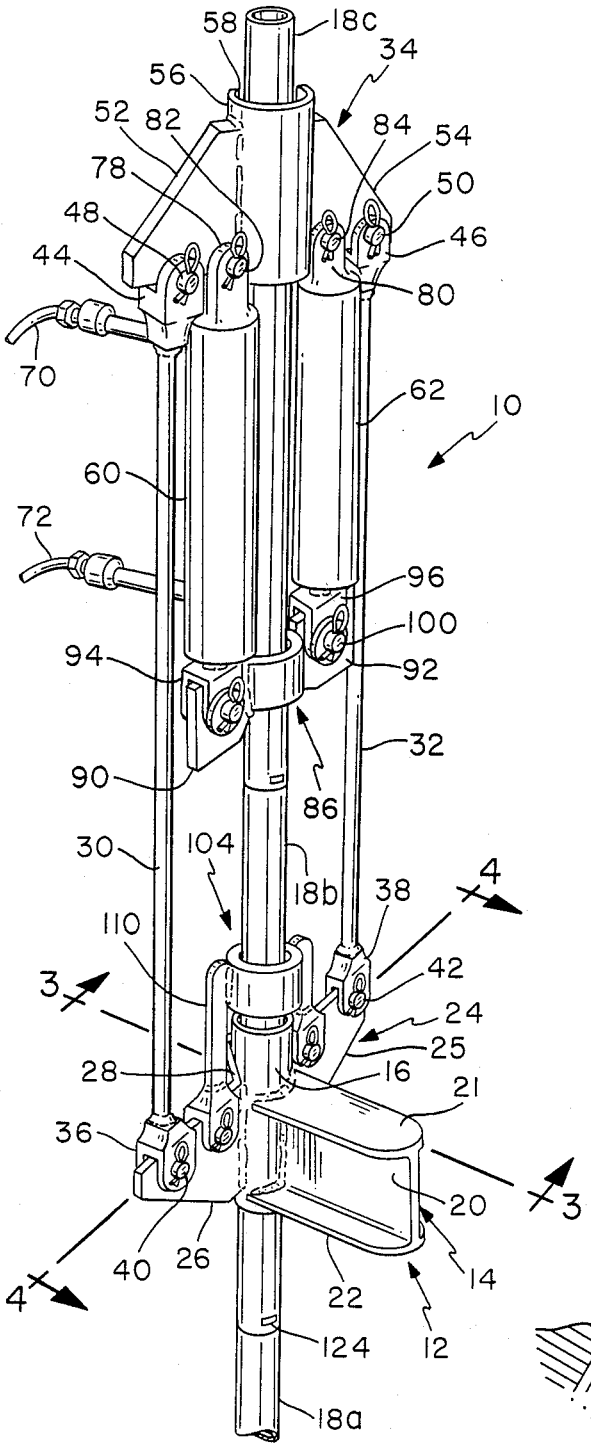
FIG. 1 is a top perspective view of the foundation stabilizing and lifting apparatus of this invention.
Figure 3:
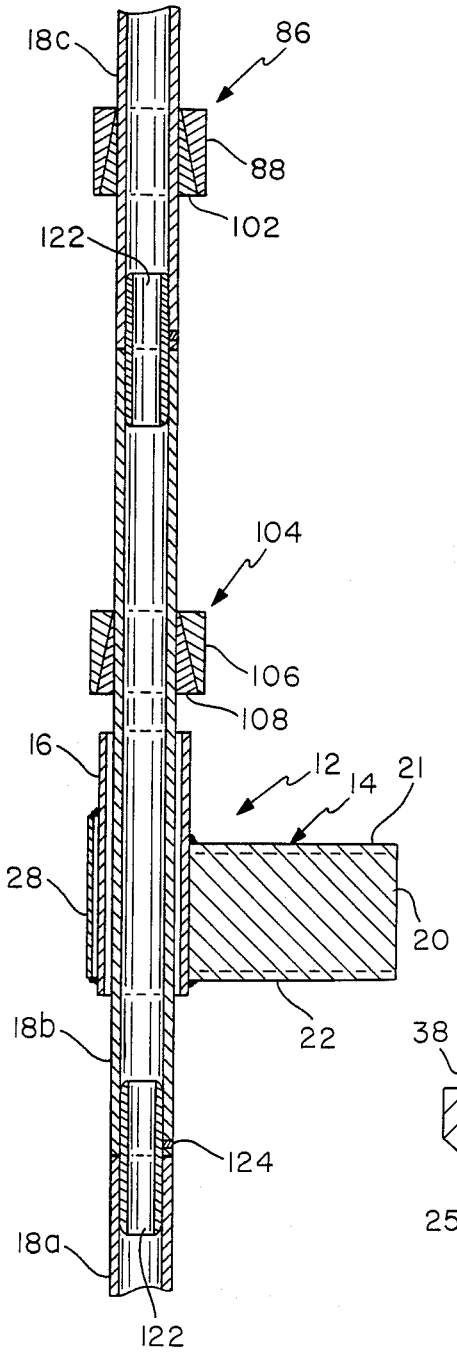
FIG. 3 is a vertical section view of the apparatus of FIG. 1 taken along lines 3—3 thereof.

Foundation bracket 12 may take various shapes. An I-beam has preferably been utilized as the foundation bracket for extension horizontally under the foundation, with the I-beam 12 being comprised of a vertical web section 20 with top and bottom flange plates 21 and 22. Various connecting means may also be utilized to secure the horizontally elongated, I-beam support segment 14 to the tubular guide sleeve 16. As is best shown in FIGS. 1 and 3, the outer ends of I-beam flange plates 21 and 22 are cut to an arcuate configuration and preferably welded to the inner face of tubular guide sleeve 16.

In order to support hydraulic drive cylinders in a desired mounting arrangement, the foundation bracket assembly is further provided with a lower cross arm 24 which is attached to the foundation bracket 12 at the location to tubular guide sleeve 16. For this purpose, cross arm 24 is preferably comprised of a single, continuous plate member having side plate segments 25 and 26 extending laterally on opposite sides of tubular guide sleeve 16 from a central, V-shaped segment 28. As may best be seen by reference to FIGS. 1 and 5, inner, V-shaped segment of the cross arm 24 is welded to the outer face of tubular guide sleeve 16.

Secured to lower cross arm side plate segments 25 and 26 are a pair of vertically extending connecting rods 30 and 32 which are utilized to support an upper head assembly 34 at an elevated location as shown. Connecting rods 30 and 32 are detachably secured at their lower ends to side plate segments 25 and 26 of lower cross arm 24 by clevis connectors 36 and 38 and pins 40 and 42 extending through the side plate segments 25 and 26 and held in place by cotter pins as shown. This structure is shown most clearly in FIGS. 1 and 5. At their upper ends, connecting rods 30 and 32 have second clevis connectors 44 aand 46 which are secured in a similar manner to laterally extending side plate members 52 and 54 of upper head assembly 34 by clevis pins 48 and 50 held in place by cotter pins as shown. The inner ends of laterally extending side plate members 52 and 54 are welded to an upper tubular guide sleeve 56, and cooperate therewith to form a generally transversely extending upper cross arm to which a pair of power cylinders 60 and 62 are mounted. As is shown in FIG. 5, the upper end of tubular guide sleeve 56 is cut away on one side thereof as indicated at 58 in order to facilitate the insertion of piling sections therethrough.

Figure 5:
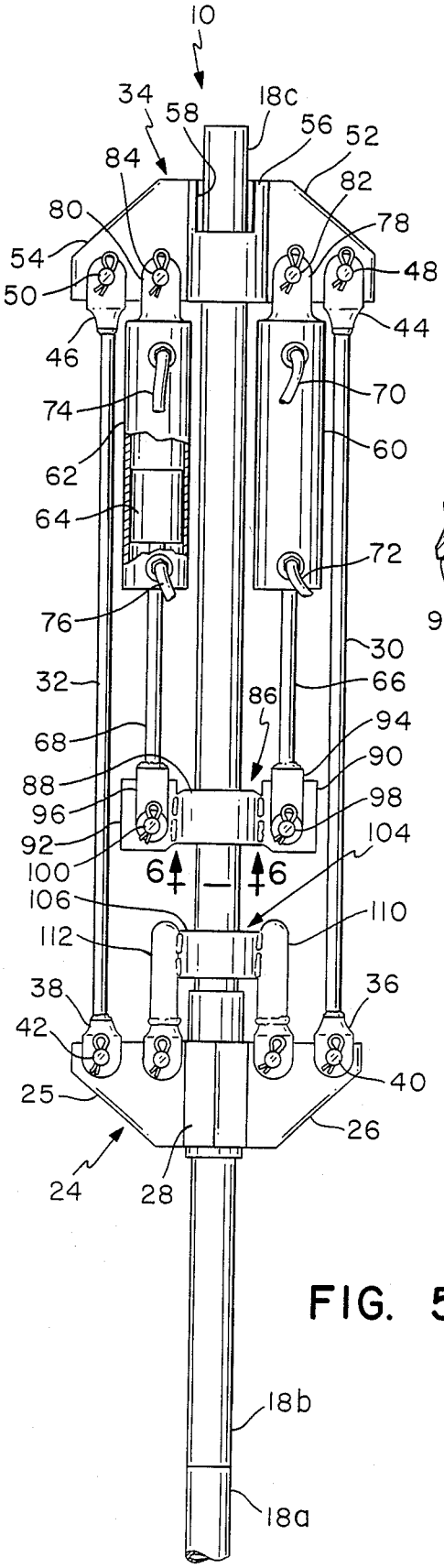
FIG. 5 is a rear elevation view of the apparatus of FIG. 1.

Each of the piling section drive cylinders 60 and 62 is of the double-acting type having a piston reciprocally moving therein, one of such pistons being shown at 64 in FIG. 5. Each piston has a piston rod 66, 68 connected to its lower end for movement therewith, with the piston rods extending downwardly from cylinders 60 and 62 towards foundation bracket 12 and lower cross arm 24. Hydraulic hoses 70, 72 and 74, 76 are connected to fittings as shown at the upper and lower ends of each of the power cylinders 60 and 62 for the alternate delivery of pressurized fluid from a fluid pump (not shown) to the top and bottom sides of the drive pistons.

Piling drive cylinders 60 and 62 are connected at their upper ends to laterally extending side plate members 52 and 54 of the upper head assembly 34 and depend downwardly therefrom towards the foundation bracket 12. For that purpose, hydraulic cylinders 60 and 62 are provided with clevis connectors 78 and 80 by means of which they are secured to side plate members 52 and 54 by clevis pins 82 and 84 extending therethrough. The clevis pins are held in place by cotter keys as shown.

Figure 4:
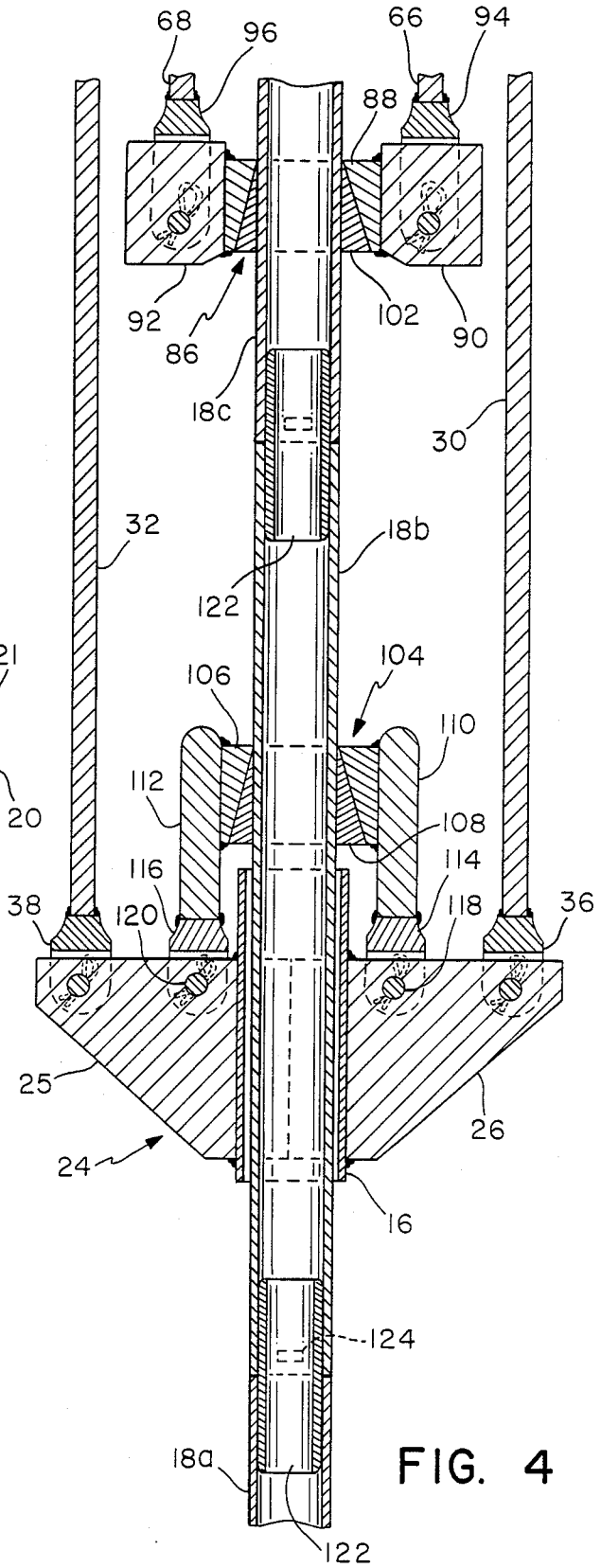
FIG. 4 is a vertical section view of the apparatus of FIG. 1 taken along lines 4—4 thereof.
Figure 6:
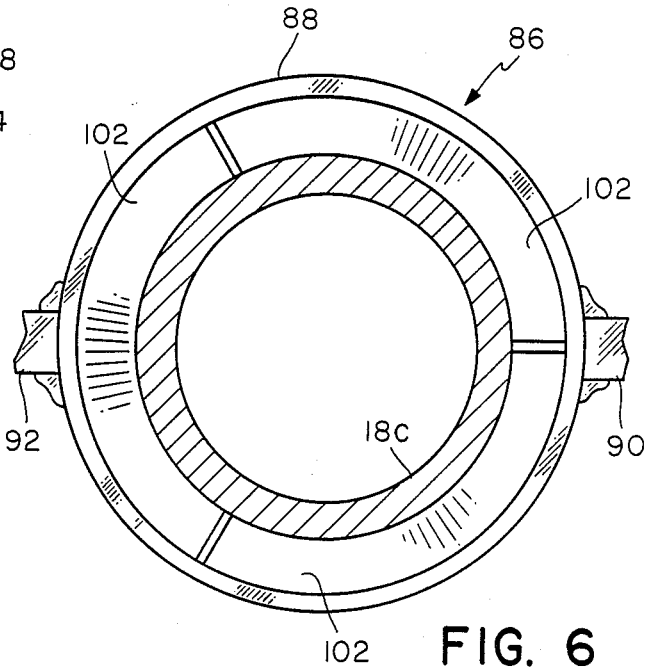
FIG. 6 is a horizontal section view taken along lines 6—6 of FIG. 5.

Disposed below power cylinders 60 and 62 at a vertical location above foundation bracket 12 and lower cross arm 24 is a slip clamp generally indicated by reference numeral 86. Slip clamp 86 has an outer housing or slip bowl 88 of tubular, cylindrical shape which embraces the piling sections 18*a*, 18*b*, and 18*c* as they are extended therethrough. FIGS. 3, 4, and 6 show the slip clamp construction. Secured to the opposed, lateral faces of slip clamp housing 88 are a pair of laterally extending mounting plates 90 and 92, which are secured to slip clamp housing 88, as by welding. Clevis connectors 94 and 96 on the bottom ends of piston rods 66 and 68 are secured to clamp mounting plates 90 and 92 by clevis pins 98 and 100, again using cotter pins to secure the clevis pins in place. With reference to FIGS. 3, 4, and 6, it will be seen that the inner face of slip clamp housing 88 is tapered upward and inwardly to receive clamping wedges 102, three of which are shown as indicated in FIG. 6 in embracing relation to the outer face of piling section 18*c*. It will thus be seen that when piston rods 66 and 68 are extended on the downward, power stroke of the hydraulic pistons, slip clamp wedges 102 will clamp against the piling section extending through the slip clamp assembly and grip the piling section so as to push it downwardly towards the ground. On the return or retraction stroke of piston rods 66 and 68, the wedges 102 will slip upwardly along the piling section. With the piston rods retracted to the position shown in FIGS. 1 and 4, the clamp will be in position to take another bite on the piling section extending therethrough; and, when the piston rods are again extended downwardly on their power stroke, the clamp 86 will grip the piling section to push it downwardly a further distance. This reciprocating, driving and retraction action of the power cylinders is repeated until each piling section is pushed downwardly over substantially its entire length.

It is to be noted that with the hydraulic cylinders 60, 62 and their pistons and piston rods arranged as shown in FIG. 5, with the piston rods extending downwardly from upper head assembly 34, the pressurized hydraulic fluid will be acting on the relatively larger top surface area of each cylinder piston 64, as compared to the reduced area of the bottom side of each piston, on the power, driving stroke of each cylinder. The bottom surface area of each cylinder piston 64 is of reduced, annular shape because of the connection of the piston rods 66 and 68 to the bottom side of each piston. Thus, maximum driving force of the power cylinders will be developed as the piston rods extend downwardly and push a piling section into the ground, because of the action of the hydraulic pressure on the relatively larger surface area at the top of the cylinder pistons. Thus, for a particular hydraulic fluid pressure, and a specific cylinder diameter, a greater driving force can be developed for forcing steel pier sections into the ground. This advantage has been accomplished with a compact, relatively short power cylinder mounting assembly as shown by mounting the power cylinders so that they depend downwardly from upper head assembly 34 on opposite sides of the pier pipe sections which are being driven, and utilizing a slip clamp 86 as described above to couple the bottom ends of piston rods 66 and 68 to the piling sections on the drive stroke of the power cylinders.

In order to avoid "flexing" of the foundation of a building on the return stroke of the power cylinders, when the piling sections are released by slip clamp 86, a second slip clamp 104 is utilized. Slip clamp 104 is of the same overall construction as slip clamp 86. It comprises an outer housing or bowl 106 through which the piling sections are extended as shown in FIGS. 3 and 4. Clamping wedges 108 are arranged as shown inside the inclined, inner wall surface of outer housing 106. Slip clamp 104 must be coupled or connected to the foundation bracket so as to hold the foundation bracket, and thus the foundation of the building being stabilized against downward movement on the return stroke of the piston rods 66 and 68. That could be accomplished in various ways, and slip clamp 104 could be located vertically at different positions along the height of the piling column which is being formed. For example, slip clamp 104 could be secured at the upper end of the power cylinder mounting assembly and attached to upper head assembly 34, as by bolting or welding to upper tubular guide sleeve 56 or to laterally extending side plates 52, 54. In the embodiment shown, slip clamp 104 has been secured to lower cross arm 24 by vertically extending bracket arms 110, 112. Bracket arms 110 and 112 are secured to opposed, lateral faces of the second slip clamp 104, as by welding. Clevis connectors 114 and 116 on the bottom ends of bracket arms 110 and 112 are attached to lower side plate segments 25 and 26 of lower cross arm 24 by clevis pins 118 and 120.

In operation, after an excavation 8 is dug adjacent to the foundation of a building which has settled, and which needs stabilizing, foundation bracket 12 is positioned in the excavation so that elongated foundation support segment or arm 14 extends generally horizontally, under the foundation and in abutting relationship therewith as shown in FIG. 2. With the foundation bracket so positioned, tubular guide sleeve 16 will be extending generally vertically, closely adjacent to the side wall of the foundation and building. For convenience of assembly, the second or lower slip clamp 104 would next be installed with its cylindrical housing or bowl 106 in axial alignment with tubular guide sleeve 16, as shown in FIGS. 1 and 2. Clevis connectors 114 and 116 are slipped over side plate segments 25, 26 of the lower cross arm 24 and secured thereto by clevis pins 118 and 120, which are inserted through predrilled holes in the side plates 25 and 26. Thereafter, connecting rods 30 and 32 of the power cylinder mounting assembly are secured to the outer ends of lower cross arm side plates 25 and 26 by means of clevis connectors 36 and 38. Clevis pins 40 and 42 are inserted through predrilled holes in plates 25 and 26 for that purpose, and cotter pins are used to hold the clevis pins in place, the same as is done with respect to clevis pins 118 and 120. The remainder of the power cylinder mounting and support assembly will have been preassembled, with the upper ends of connecting rods 30 and 32, as well as the upper ends of power cylinders 60 and 62 secured to upper head assembly side plates 52 and 54 by their respective clevis connections.

With the power cylinders thus mounted adjacent to the building wall and the driving slip clamp 86 connected to the lower clevis connections 94 and 96 of the piston rods 66 and 68, through the slip clamp mounting plates 90 and 92, slip clamp housing 88 will be positioned in axial alignment with the lower slip clamp housing 106 and with tubular guide sleeve 16.

A first piling section comprising a tubular steel pier pipe **18*a* is then inserted through upper tubular guide sleeve 56, and then downwardly through slip clamp housings 88 and 106. The power cylinders 60 and 62 are then actuated by supplying hydraulic fluid thereto. As piston rods 66 and 68 are extended downwardly on their power stroke, the wedges 102 of slip clamp 86 grip the upper end of the piling section and push it downwardly through tubular guide sleeve 16 of the foundation bracket. Clamp 86 slides upwardly along the piling section on the return stroke of piston rods 66 and 68. Repeated reciprocation of the power cylinder drives the first piling section 18*a* downwardly into the ground. Thereafter, a series of piling sections 18*b*; 18*c*, etc., are sequentially driven into the ground, one after the other in abutting relationship to provide a piling section column. It is to be noted that the combination of upper, tubular guide sleeve 56 with the lower foundation bracket guide sleeve 16 serves particularly well to guide the piling sections as they are being driven downwardly. The upper tubular guide sleeve 56 also assists in the insertion and guiding of each pipe section as it is guided through the upper slip clamp housing 88**.

The upper end of each piling section is coupled to the lower end of the following piling section. This can be done in various ways. A relatively short, one foot long, tubular coupling insert 122 has been found to be effective for this purpose. Coupling tube 122 is inserted in the bottom end of each pipe section to extend upwardly therein. An arcuate welding slot 124 as shown in FIGS. 1 and 3 is cut through the wall adjacent the lower end of that piling section. A plug weld is then carried out through the slot to secure the coupling insert within the lower end of the piling section, and the weld is machined smooth on the outside. Thereafter, the lower end of the next piling section being positioned is brought into abutting engagement with the top end of the preceding piling section, with coupling insert 122 extending downwardly into the top end of the preceding piling section. This coupling arrangement of the adjacent piling sections is shown with respect to piling sections **18*a*, 18*b*, and 18*c* in FIGS. 1, 3, and 4**.

In the course of sequentially driving the successive piling sections into the ground by power cylinders 60 and 62, the second slip clamp 104 operates to substantially overcome the problem of the foundation of the building "flexing" and settling downwardly a very slight distance, even a fraction of an inch, on each return stroke of piston rods 66 and 68. During that return stroke of the power cylinders, slip clamp 86 will be released and will be sliding upwardly on the piling section which is being driven. At that time, there is a tendency for the foundation bracket 12 and its tubular guide sleeve 16 to slide downwardly on the piling section extending therethrough, under the weight of the building foundation. Second slip clamp 104 overcomes that problem by the gripping action of its clamping wedges 108 against a pier-pipe section on the return stroke of piston rods 66 and 68. Slip clamp 104 is constructed and arranged, and has its wedges oriented in the same way as slip clamp 86. However, since slip clamp 104 is fixed by its connection through bracket arms 110 and 112 to plates 25, 26 of the lower cross arm 24, clamping wedges 108 do not resist the downward, driving movement of the piling sections therethrough on the extension stroke of piston rods 66 and 68. However, on the retraction stroke of piston rods 66 and 68, the tendency of the lower cross arm 24 and tubular guide sleeve 16 to which it is attached to slide downwardly with the foundation on the piling section extending therethrough is resisted by the clamping action of wedges 108 against the outside surface of the piling section as the outer, tapered slip bowl or housing 106 exerts a downward force imparted to it by the building foundation through the lower cross arm 24. In this way, the "flexing" of a building foundation is resisted by the restraining action of the second slip clamp 104 acting against the piling sections which have already been driven into the ground.

The compact arrangement and relatively low overall height of the power cylinder mounting assembly disclosed herein, utilizing a lower cross arm 24 and an upper head assembly 34 connected by rods 30 and 32, provides particular operating advantages. On prior art devices, such as that disclosed in the aforesaid patents to Langenbach, Shaw et al, and May, there is a relatively long, unsupported length of each piling section between the top of the tubular guide sleeve on the foundation bracket and the bottom end of the drive cylinder piston rods when the piston rods are in position to commence a driving stroke to push or pull a piling section into the ground. This provides a relatively long lever arm acting against the unsupported length of the piling section during the cylinder driving stroke, which can cause bending of the piling section and also cause the foundation bracket to be forced outwardly away from the foundation so as to cant or tip the upper end of each piling section inwardly towards the building wall. In the apparatus disclosed herein, there is only a relatively short distance of approximately 24 inches from the bottom ends of the piston rods 66 and 68 in their retracted positions as shown in FIG. 1 to the top end of the tubular guide sleeve 16. The tendency to bend or tip the piling sections under the driving force of the power cylinders is thus greatly reduced, if not eliminated.

An attendant advantage flowing from the aforesaid cylinder mounting and piling section support arrangement is that larger diameter cylinders generating greater driving forces may be utilized. With prior art apparatus as referenced herein, the tendency of the piling sections to bend or tip when being driven over a relatively long, unsupported distance required the use of smaller power cylinders generating lesser driving forces, so as to avoid tipping or bending the piling sections. The utilization of larger diameter power cylinders, in combination with the cylinder arrangement disclosed herein wherein the cylinders extend downwardly so that maximum driving power is developed on the larger area at the top of the cylinder piston on the piling section driving stroke permits much larger driving forces to be utilized. This makes it possible to drive piling sections deeper and faster into the ground, and also to generate greater lifting forces for elevating particularly heavy homes or commercial structures.

It is frequently necessary to drive a number of piling section columns around the foundation of a settled building structure to properly stabilize and elevate the foundation. Only one piling section column is driven at a time. The columns are spaced apart on the order of 8–10 feet. As each column of piling sections is being driven, the horizontal arm 14 of foundation bracket 12 acts upwardly against the bottom of the foundation. As piston rods 66 and 68 extend downwardly on the piling section driving stroke, there is an upward, reaction force through power cylinders 60 and 62 which is transmitted through connecting rods 30 and 32 to the foundation bracket 12, and thus to the building foundation. It is that reaction force which causes the foundation to be lifted upwardly a slight distance on each driving stroke of the power cylinders. After a piling section column is driven at one location, the foundation is allowed to settle to its original level. Subsequent piling columns are then driven around the foundation as required. After bedrock or a solid, load support strata has been reached, additional driving force is supplied to the power cylinders secured to the several piling columns, simultaneously, to elevate the foundation back to the desired level. The upward, reaction force of the piling columns acting against solid bedrock causes the foundation to be lifted.

After the foundation has been stabilized and elevated, the tubular guide sleeve 16 of each foundation bracket 12 is welded, bolted, or otherwise secured to the piling section extending therethrough. This serves to positively secure the foundation bracket to the piling section so that the load of the building at its foundations will now be supported on the piling columns.

Thereafter, the clevis connectors 36 and 38 of connecting rods 30 and 32 are detached from the lower cross arm side plates 25 and 26, and the upwardly extending power cylinder support apparatus is removed. The second or lower slip clamp 104 is also removed for use on other installations.

It is anticipated that various changes and modifications may be made in the construction, arrangement and operation of the foundation stabilizing and lifting apparatus disclosed herein without departing from the spirit and scope of the invention as defined by the following claims.

WHAT IS CLAIMED IS:

1. Apparatus for stabilizing and supporting a building foundation comprising:

a foundation bracket assembly comprising an elongated foundation support segment adapted to extend generally horizontally under a building foundation, and vertically oriented, guide means substantially at the level of said foundation support segment adapted to receive and guide foundation support pilings to be driven into the ground;

lower cross arm means on said foundation bracket assembly and extending laterally outwardly on opposite sides of said guide means;

an upper head assembly located above said foundation bracket assembly in vertically spaced relation thereto;

connecting rod means extending between and secured to said upper head assembly and said foundation bracket assembly said connecting rod means comprising two connecting rods extending vertically and secured at their lower ends to said lower cross arm means on opposite sides of said guide means;

at least one power cylinder connected at the upper end thereof to said upper head assembly and depending downwardly therefrom towards said foundation bracket assembly at a laterally offset position with respect to the vertical path of support pilings to be driven into the ground, said power cylinder comprising piston reciprocally moveable within a cylinder and a piston rod attached to said piston and extending downwardly therefrom outside of said cylinder; and a clamp connected to said piston rod at a vertical location above said foundation bracket and below said upper head assembly and having clamp means adapted to engage and grip a length of foundation support piling extending through said guide means upon the downward, power extension stroke of said piston and piston rod.

2. Apparatus for stabilizing and supporting a building foundation as defined in claim 1 wherein:

said clamp is a slip clamp and includes wedge members constructed and arranged to engage and grip a length of foundation support piling upon the downward, extension stroke of said piston and piston rod and to release said piling upon the upward, retraction stroke of said piston and piston rod.

3. Apparatus for stabilizing and supporting a building foundation as defined in claim 1 wherein:

said guide means has walls adapted to embrace and guide support pilings and said lower cross arm means comprises a pair of mounting arm members affixed to said guide means walls and projecting laterally outwardly therefrom on opposite sides of said guide means. .

4. Apparatus for stabilizing and supporting a building foundation as defined in claim 1 wherein:

two power cylinders are connected at their upper ends to said upper head assembly and depend downwardly therefrom at laterally spaced-apart locations on opposite sides of the vertical path of support pilings to be driven into the ground through said guide means, each of said power cylinders having a piston reciprocally moveable therein with a piston rod connected to its bottom end, and each of said piston rods being attached at their lower ends to said clamp on opposite sides thereof.

5. Apparatus for stabilizing and supporting a building foundation as defined in claim 4 wherein:

said clamp is a slip clamp vertically positioned between said foundation bracket and said upper head assembly and comprises a generally cylindrical clamp housing adapted to embrace lengths of support pilings inserted therethrough and containing piling-engaging wedge members which function as said clamp means, and the lower ends of said piston rods being connected to opposite sides of said clamp housing 6. Apparatus for stabilizing and supporting a building foundation as defined in claim 1 wherein:

said upper head assembly comprises transversely extending cross arm means to which said power cylinder is attached, said cross arm means having second guide means thereon through which lengths of pilings to be driven into the ground by said power cylinder are slidably received and guided.

7. Apparatus for stabilizing and supporting a building foundation as defined in claim 6 wherein:

said transversely extending cross arm means comprises transversely extending members between which said second guide means is positioned and supported; and two power cylinders are connected at their upper ends to said transversely extending members of said upper head assembly at laterally spaced locations on opposite sides of said second tubular guide means, each of said power cylinders having a piston reciprocally moveable therein with a piston rod depending from and connected to the bottom end of each of said pistons, said piston rods being attached at their lower ends to opposite sides of said clamp.

8. Apparatus for stabilizing and supporting a building foundation as defined in claim 7 wherein:

said connecting rods are detachably secured at their lower ends to said lower cross arm means, said connecting rods being attached at their upper ends to the outside of said laterally extending members of said upper head assembly, laterally outwardly from each of said power cylinders.

9. Apparatus for stabilizing and supporting a building foundation comprising:

a foundation bracket assembly comprising an elongated foundation support segment adapted to extend generally horizontally under a building foundation in engagement therewith and vertically oriented, guide means adapted to receive and guide foundation support pilings to be driven into the ground;

at least one power cylinder supported from said foundation bracket assembly and comprising a piston reciprocally moveable within a cylinder and a piston rod attached to said piston and extending outwardly from said cylinder;

first clamp means connected to said piston rod at a vertical location above said foundation bracket assembly and having clamp means adapted to engage and grip a length of foundation support piling being driven through said guide means, upon the piling drive stroke of said piston and piston rod and to release said piling upon the return stroke of said piston and piston rod; and a second clamp supported along the vertical path of support pilings to be driven into the ground through said guide means, said second clamp being so constructed and arranged as to grip a length of support piling forming a section of a piling column extending through said guide means on the return stroke of said piston and piston rod, so as to prevent the downward movement of said foundation bracket assembly, and thus of a building foundation being engaged by said elongated foundation support segment, when said clamp connected to said piston rod releases a piling section on said piston return stroke.

10. Apparatus for stabilizing and supporting a building foundation as defined in claim 9 wherein:

both said first and second clamps are slip clamps comprising a clamp housing adapted to embrace lengths of support pilings guided therethrough and containing pipe-engaging wedge members oriented to selectively engage piling sections.

11. Apparatus for stabilizing and supporting a building foundation as defined in claim 10 wherein:

said second clamp is located above said guide means.

12. Apparatus for stabilizing and supporting a building foundation comprising:

a foundation bracket assembly comprising an elongated foundation support segment adapted to extend generally horizontally under a building foundation, and vertically oriented, guide means adapted to receive and guide foundation support pilings to be driven into the ground;

an upper head assembly located above said foundation bracket assembly in vertically spaced relation thereto;

connecting rod means extending between and secured to said upper head assembly and said foundation bracket assembly;

at least one power cylinder connected at the upper end thereof to said upper head assembly and depending downwardly therefrom towards said foundation bracket assembly at a laterally offset position with respect to the vertical path of support pilings to be driven into the ground, said power cylinder comprising a piston reciprocally moveable within a cylinder and a piston rod attached to said piston and extending downwardly therefrom outside of said cylinder; and a clamp connected to said piston rod at a vertical location above said foundation bracket and having clamp means adapted to engage and grip a length of foundation support piling extending through said guide means upon the downward, power extension stroke of said piston and piston rod, said clamp being a slip clamp and including wedge members constructed and arranged to engage and grip a length of foundation support piling upon the downward, extension stroke of said piston and piston rod and to release said piling upon the upward, retraction stroke of said piston and piston rod; and a second slip clamp supported along the vertical path of support pilings to be driven into the ground through said guide means, said second clamp being connected to said foundation bracket assembly and so constructed and arranged as to grip a length of support piling forming a section of a piling column extending through said guide means on the retraction stroke of said piston and piston rod, so as to prevent the downward movement of said foundation bracket assembly, and thus of a building foundation being engaged by said elongated foundation support segment, when said clamp connected to said piston rod releases a piling section on said retraction stroke.

13. Apparatus for stabilizing and supporting a building foundation as defined in claim 12 wherein:

said foundation bracket assembly further comprises lower cross arm means projecting laterally outwardly on opposite sides of said guide means, and said connecting rod means and said second clamp are both detachably connected to said lower cross arm means.

* * * * *